US012532939B2

(12) United States Patent
Fahmi et al.

(10) Patent No.: US 12,532,939 B2
(45) Date of Patent: Jan. 27, 2026

(54) ARTICLE OF FOOTWEAR

(71) Applicant: NIKE, Inc., Beaverton, OR (US)

(72) Inventors: Windra Fahmi, Beaverton, OR (US); Erin Gleason, Beaverton, OR (US); Jin Hong, Beaverton, OR (US); Liao Kuang-Nan, Portland, OR (US); Jaroslav J. Lupinek, Portland, OR (US); Stuart D. Pollock, Milwaukie, OR (US); Chloe Scott, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/352,502

(22) Filed: Jul. 14, 2023

(65) Prior Publication Data

US 2023/0354955 A1 Nov. 9, 2023

Related U.S. Application Data

(63) Continuation of application No. 17/115,768, filed on Dec. 8, 2020, now Pat. No. 11,737,509.
(Continued)

(51) Int. Cl.
*A43B 7/144* (2022.01)
*A43B 13/04* (2006.01)
(Continued)

(52) U.S. Cl.
CPC ..... *A43B 7/144* (2013.01); *A43B 13/04* (2013.01); *A43B 13/122* (2013.01);
(Continued)

(58) Field of Classification Search
CPC ..... A43B 7/144; A43B 13/04; A43B 13/122; A43B 13/125; A43B 13/127;
(Continued)

(56) References Cited

U.S. PATENT DOCUMENTS 6,009,637 A 1/2000 Pavone
7,788,824 B2 9/2010 Hann
(Continued)

FOREIGN PATENT DOCUMENTS

JP 2001029110 A 2/2001
JP 2015529136 A 10/2015
(Continued)

OTHER PUBLICATIONS

International Search Report for Application PCT/US2020/063916 dated Mar. 5, 2021.
(Continued)

*Primary Examiner* — Haley A Smith
(74) *Attorney, Agent, or Firm* — Honigman LLP; Matthew H. Szalach; Jonathan P. O'Brien

(57) ABSTRACT

An article of footwear includes an upper and a plate having a top surface facing the upper and a bottom surface formed on an opposite side than the top surface, the plate extending from a first end in a forefoot region to a second end in a heel region. A first cushioning element is attached to the bottom surface of the plate in the forefoot region and a second cushioning element is attached to the bottom surface of the plate in the heel region, the second cushioning element being separated from the first cushioning element by a first gap
(Continued)

formed in a mid-foot region. One or more fluid-filled bladders are each at least partially surrounded by the first cushioning element in the forefoot region and have a top surface attached to the bottom surface of the plate.

17 Claims, 17 Drawing Sheets

Related U.S. Application Data

(60) Provisional application No. 62/945,826, filed on Dec. 9, 2019.

(51) Int. Cl.
*A43B 13/12* (2006.01)
*A43B 13/18* (2006.01)
*A43B 13/20* (2006.01)
*A43B 21/28* (2006.01)

(52) U.S. Cl.
CPC ..... *A43B 13/125* (2013.01); *A43B 13/127* (2013.01); *A43B 13/188* (2013.01); *A43B 13/20* (2013.01); *A43B 13/206* (2013.01); *A43B 21/28* (2013.01)

(58) Field of Classification Search
CPC ..... A43B 13/188; A43B 13/20; A43B 21/28; A43B 13/41; A43B 13/026
USPC ..... 36/107, 108
See application file for complete search history.

(56) References Cited

U.S. PATENT DOCUMENTS

| | | | | |
|---|---|---|---|---|
| 10,251,445 | B2 | 4/2019 | McDonald | |
| 2005/0268488 | A1 | 12/2005 | Hann | |
| 2007/0220778 | A1 | 9/2007 | Fusco et al. | |
| 2009/0165333 | A1* | 7/2009 | Litchfield | A43B 13/203 36/35 B |
| 2016/0324254 | A1 | 11/2016 | McDonald | |
| 2018/0213886 | A1* | 8/2018 | Connell | A43B 13/184 |
| 2019/0320759 | A1* | 10/2019 | Conrad | A43B 13/181 |
| 2022/0022597 | A1 | 1/2022 | Bowman et al. | |
| 2023/0270207 | A1* | 8/2023 | Stauffer | A43B 13/185 36/28 |

FOREIGN PATENT DOCUMENTS

| | | | |
|---|---|---|---|
| WO | WO-2018144756 | A1 | 8/2018 |
| WO | WO-2018169537 | A1 | 9/2018 |
| WO | WO-2019204077 | A1 | 10/2019 |

OTHER PUBLICATIONS

United States Patent and Trademark Office, Non-Final Office Action for U.S. Appl. No. 17/115,768 mailed Jun. 27, 2022.
Japan Patent Office, Notice of Reasons for Refusal for JP App. No. 2022-534355, mailed Jun. 20, 2023.
United States Patent and Trademark Office, Final Office Action for U.S. Appl. No. 17/115,768 mailed Jan. 20, 2023.

* cited by examiner

ARTICLE OF FOOTWEAR

CROSS REFERENCE TO RELATED APPLICATIONS

This application is a continuation of U.S. application Ser. No. 17/115,768, filed Dec. 8, 2020, which claims priority under 35 U.S.C. § 119(e) to U.S. Provisional Application No. 62/945,826, filed on Dec. 9, 2019. The disclosures of these prior applications are considered part of the disclosure of this application and are hereby incorporated by reference in their entirety.

FIELD

The present disclosure relates generally to sole structures for articles of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole and/or a sockliner located within a void proximate to the bottom portion of the upper.

High-intensity interval training (MIT) workouts alternate bouts of going all-out with periods of rest to recover. The movements are diverse—burpees, kettlebell swings, lunges, mountain climbers, push-ups, squats and many more—and are sequenced to get maximum impact from maximum effort. In HITT workout classes, athletes typically wear footwear that is optimized for cushioning or footwear that is optimized for support. Unfortunately, such footwear, while adequate for its intended purpose (i.e., cushioning or support), isn't designed to concurrently provide both benefits and, as a result, do not perform optimally during HIIT movements.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
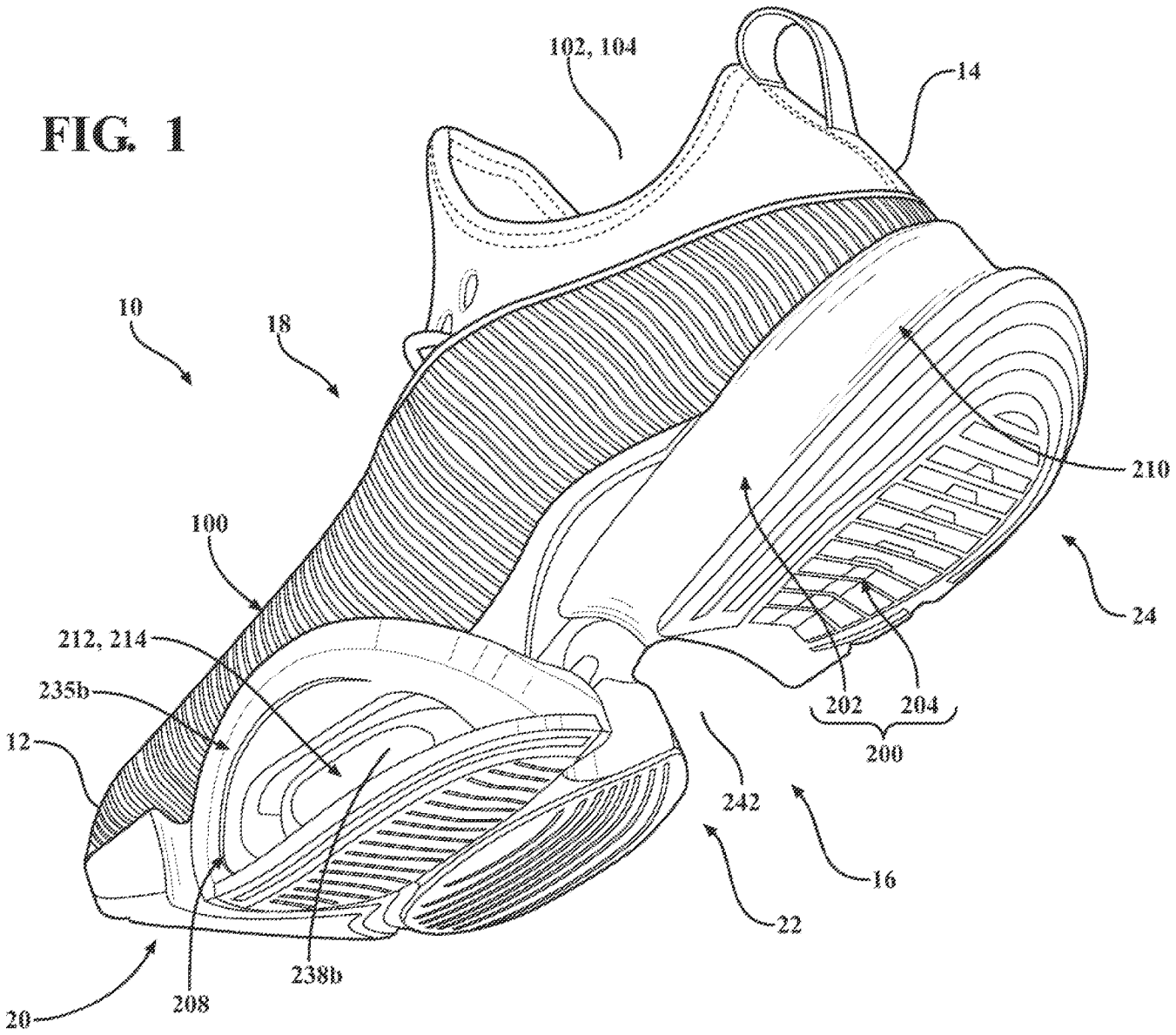
FIG. 1 is a bottom perspective view of an article of footwear according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure includes an article of footwear. The article of footwear includes an upper. The article of footwear also includes a plate having a top surface facing the upper and a bottom surface formed on an opposite side than the top surface, the plate extending from a first end in a forefoot region to a second end in a heel region. The article of footwear also includes a first cushioning element having an upper surface attached to the bottom surface of the plate in the forefoot region and including a first side shield extending from the upper surface and along a medial side of the upper and a second side shield extending from the upper surface and along a lateral side of the upper. The article of footwear also includes one or more fluid-filled bladders each at least partially surrounded by the first cushioning element in the forefoot region and having a top surface attached to the bottom surface of the plate.

This aspect of the disclosure may include one or more of the following optional features. In some examples, the one or more fluid-filled bladders includes a first fluid-filled bladder disposed on a medial side and a second fluid-filled bladder disposed on a lateral side. In some implementations, the first end of the plate includes a lateral portion and a medial portion separated from the lateral portion by a gap. In some configurations, the first cushioning element includes one or more apertures each configured to receive a corresponding one of the one or more fluid-filled bladders.

In some examples, each of the plate and the upper are received between the first side shield and the second side shield. In some configurations, one or more fluid-filled bladders is disposed between the first side shield and the second side shield. In some implementations, the first side shield and the second side shield include an arch extending from a first end to a second end along the respective side of the article of footwear.

Optionally, the article of footwear may include a second cushioning element disposed in the heel region and spaced apart from the first cushioning element by a gap in a mid-foot region of the article of footwear. Here, the article of footwear may include an outsole having a first fragment attached to the first cushioning element, a second fragment attached to the second cushioning element, and a third fragment attached to the one or more fluid-filled bladders. In some examples, the plate includes one or more upper sockets each receiving a first end of one of the one or more bladders and the outsole includes one or more lower sockets each receiving a second end of one of the one or more bladders.

Another aspect of the disclosure provides an article of footwear including an upper and a plate having a top surface facing the upper and a bottom surface formed on an opposite side than the top surface. The plate extends from a first end in a forefoot region to a second end in a heel region. The article of footwear also includes first cushioning element having an upper surface attached to the bottom surface of the plate in the forefoot region and including a first side shield defining a first opening formed in a lateral side of the first cushioning element and a second shield defining a second opening formed in a medial side of the first cushioning element. The article of footwear further includes one or more fluid-filled bladders each at least partially surrounded by the first cushioning element in the forefoot region and having a top surface attached to the bottom surface of the plate.

This aspect of the disclosure may include one or more of the following optional features. In some examples, the one or more fluid-filled bladders includes a first fluid-filled bladder disposed on a medial side and a second fluid-filled bladder disposed on a lateral side. In some implementations, the first end of the plate includes a lateral portion and a medial portion separated from the lateral portion by a gap. In some configurations, the first cushioning element includes one or more apertures each configured to receive a corresponding one of the one or more fluid-filled bladders.

In some configurations, each of the plate and the upper are received between the first side shield and the second side shield. In some examples, the one or more fluid-filled bladders is disposed between the first side shield and the second side shield. In some implementations, each of the first side shield and the second side shield includes an arch extending from a first end to a second end along the respective side of the article of footwear.

In some examples, the article of footwear further includes a second cushioning element disposed in the heel region and spaced apart from the first cushioning element by a gap in a mid-foot region of the article of footwear. In some examples, the article of footwear includes an outsole having a first fragment attached to the first cushioning element, a second fragment attached to the second cushioning element, and a third fragment attached to the one or more fluid-filled bladders. Optionally, the plate includes one or more upper sockets each receiving a first end of one of the one or more bladders and the outsole includes one or more lower sockets each receiving a second end of one of the one or more bladders.

Referring to FIG. 1, an article of footwear 10 includes an upper 100 and sole structure 200. The footwear 10 may further include an anterior end 12 associated with a forward-most point of the footwear 10, and a posterior end 14 corresponding to a rearward-most point of the footwear 10.

Figure 6:
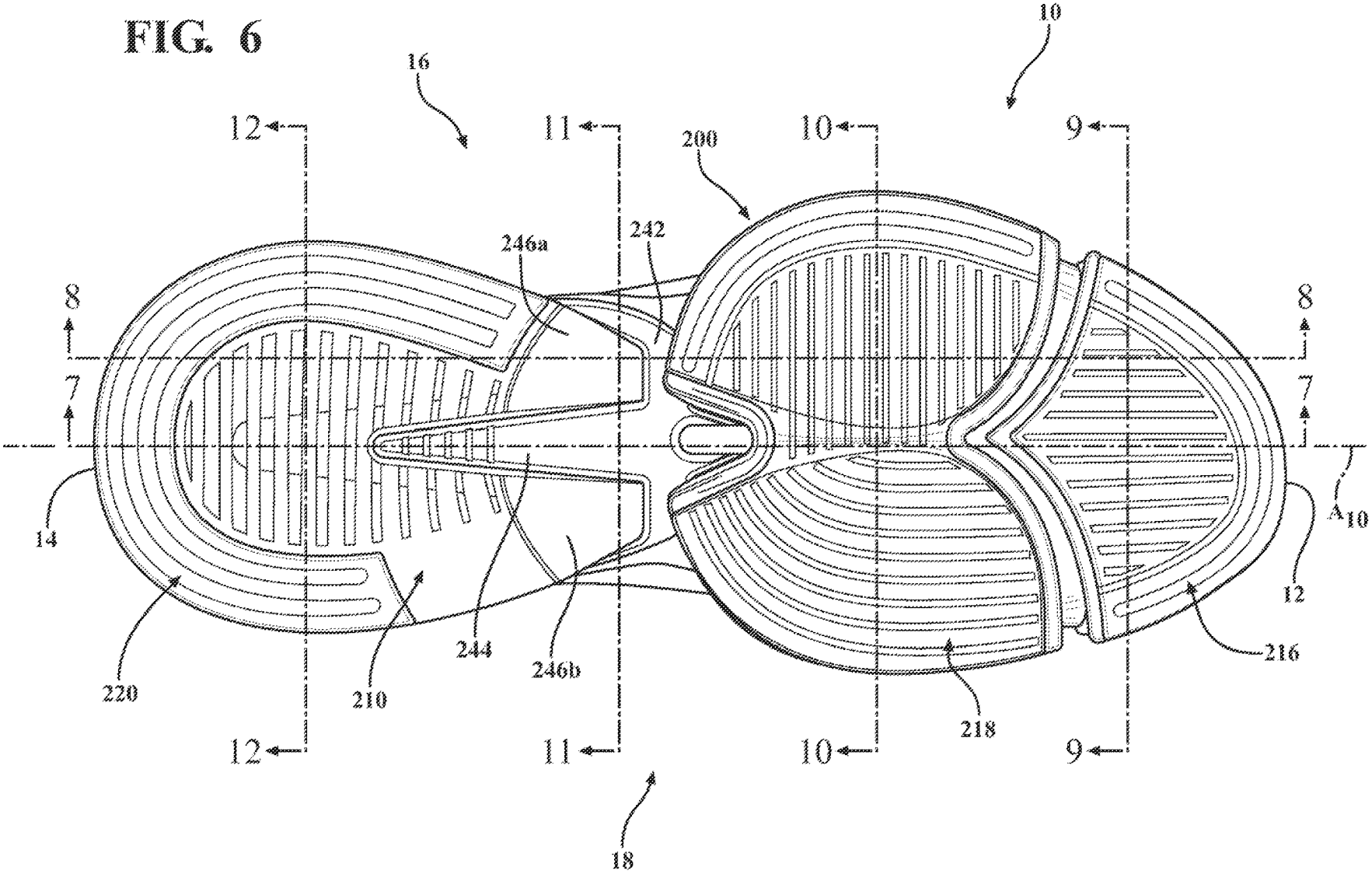
FIG. 6 is a bottom plan view of the article of footwear of FIG. 1.
Figure 7:
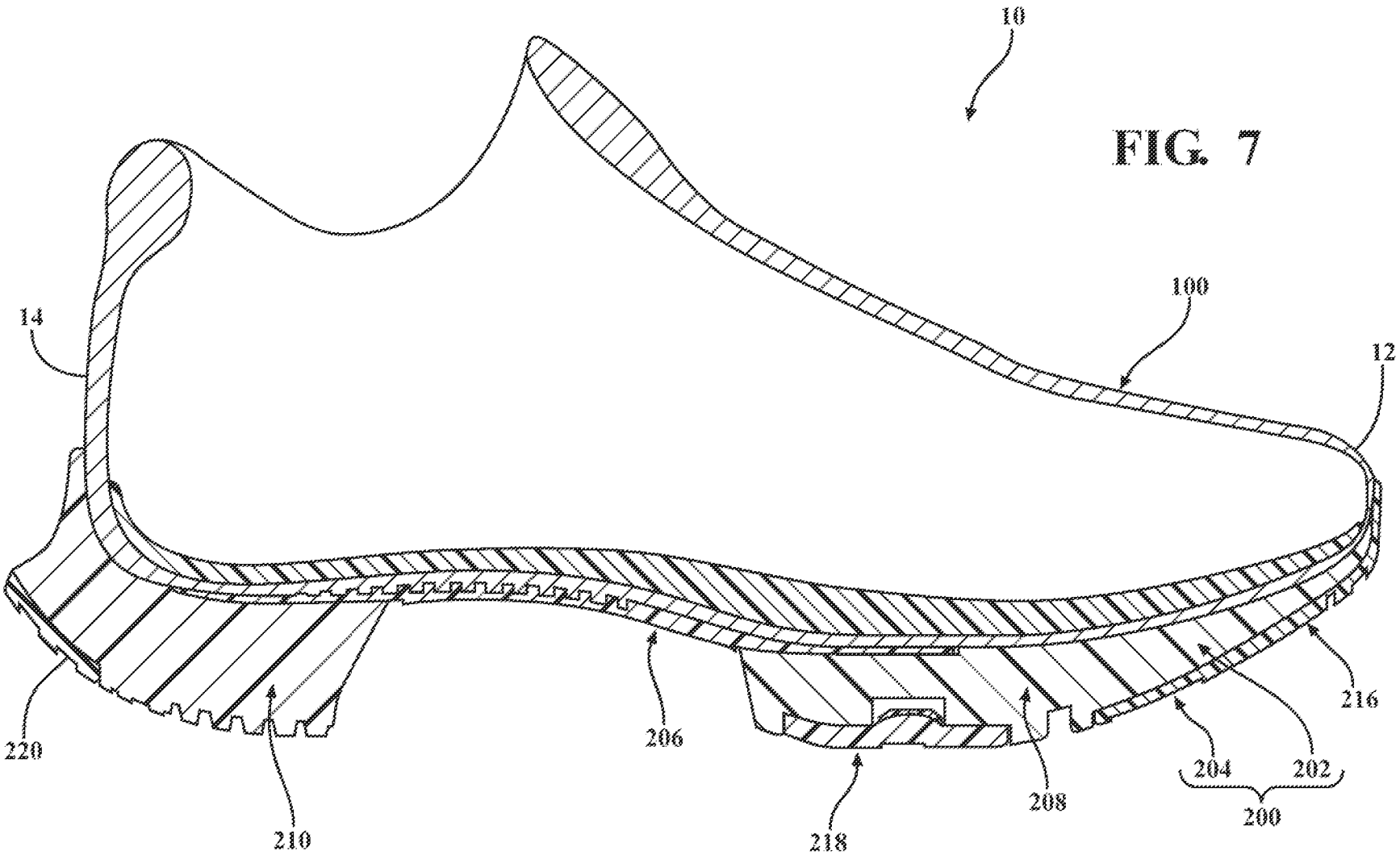
FIG. 7 is a cross-sectional view of the article of footwear of FIG. 1; taken along section line 7-7 of FIG. 6.

As shown in FIG. 6, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion 20T corresponding with phalanges and a ball portion 20B associated with metatarsal bones of a foot. The mid-foot region 22 may correspond with an arch area of the foot, and the heel region 24 may correspond with rear portions of the foot, including a calcaneus bone.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 5:
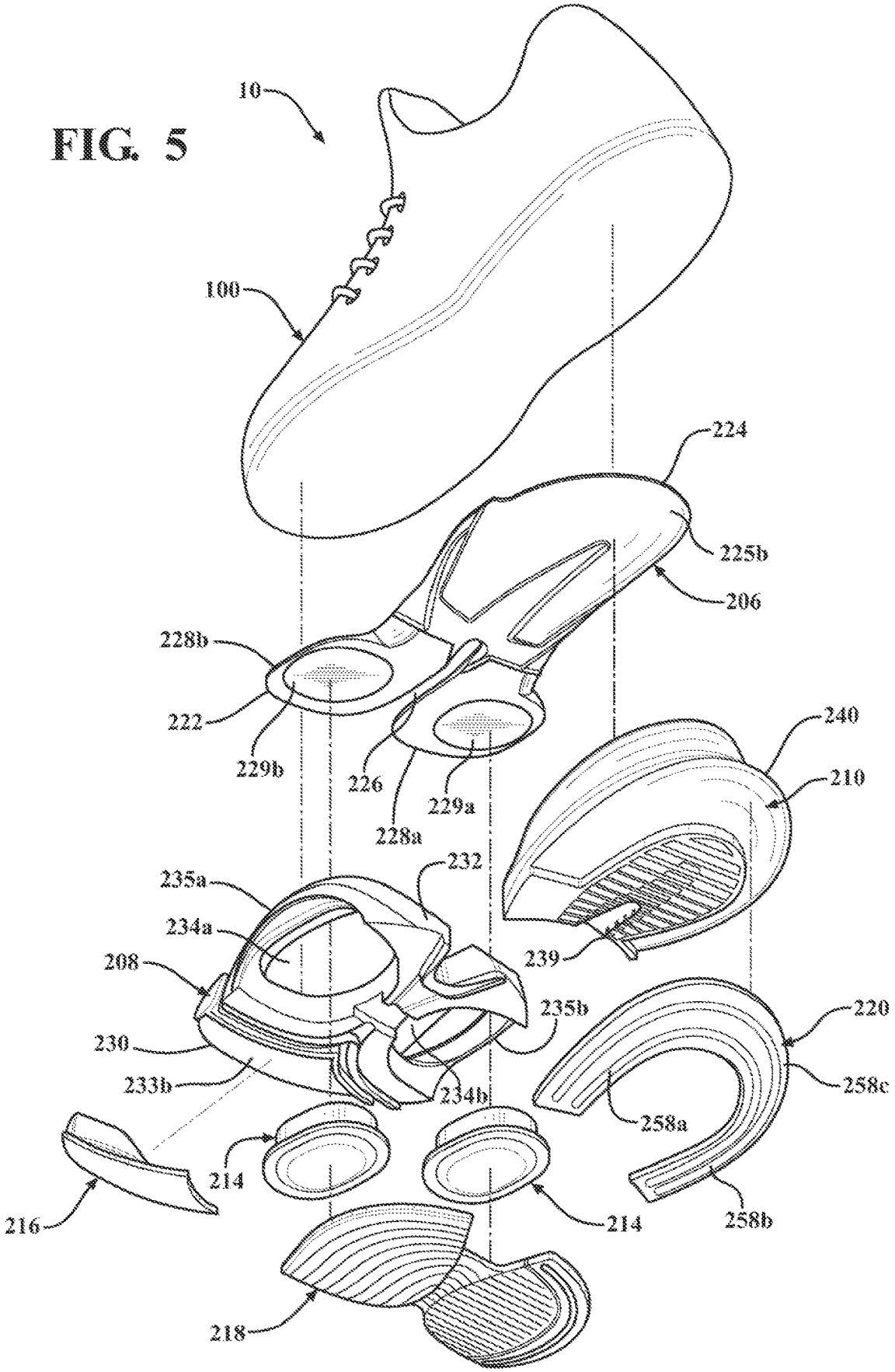
FIG. 5 is an exploded, bottom perspective view of the article of footwear of FIG. 1.

With reference to FIG. 5, in some examples, the upper 100 includes a strobel having a bottom surface opposing the sole structure 200 and an opposing top surface defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel and reside within the interior void 102 of the upper 100 to receive a plantar surface of the foot to enhance the comfort of the article of footwear 10. An ankle opening 104 in the heel region 24 may provide access to the interior void 102. For example, the ankle opening 104 may receive a foot to secure the foot within the void 102 and to facilitate entry and removal of the foot from and to the interior void 102. In some examples, one or more fasteners 106 extend along the upper 100 to adjust a fit of the interior void 102 around the foot and to accommodate entry and removal of the foot therefrom.

Figure 4:
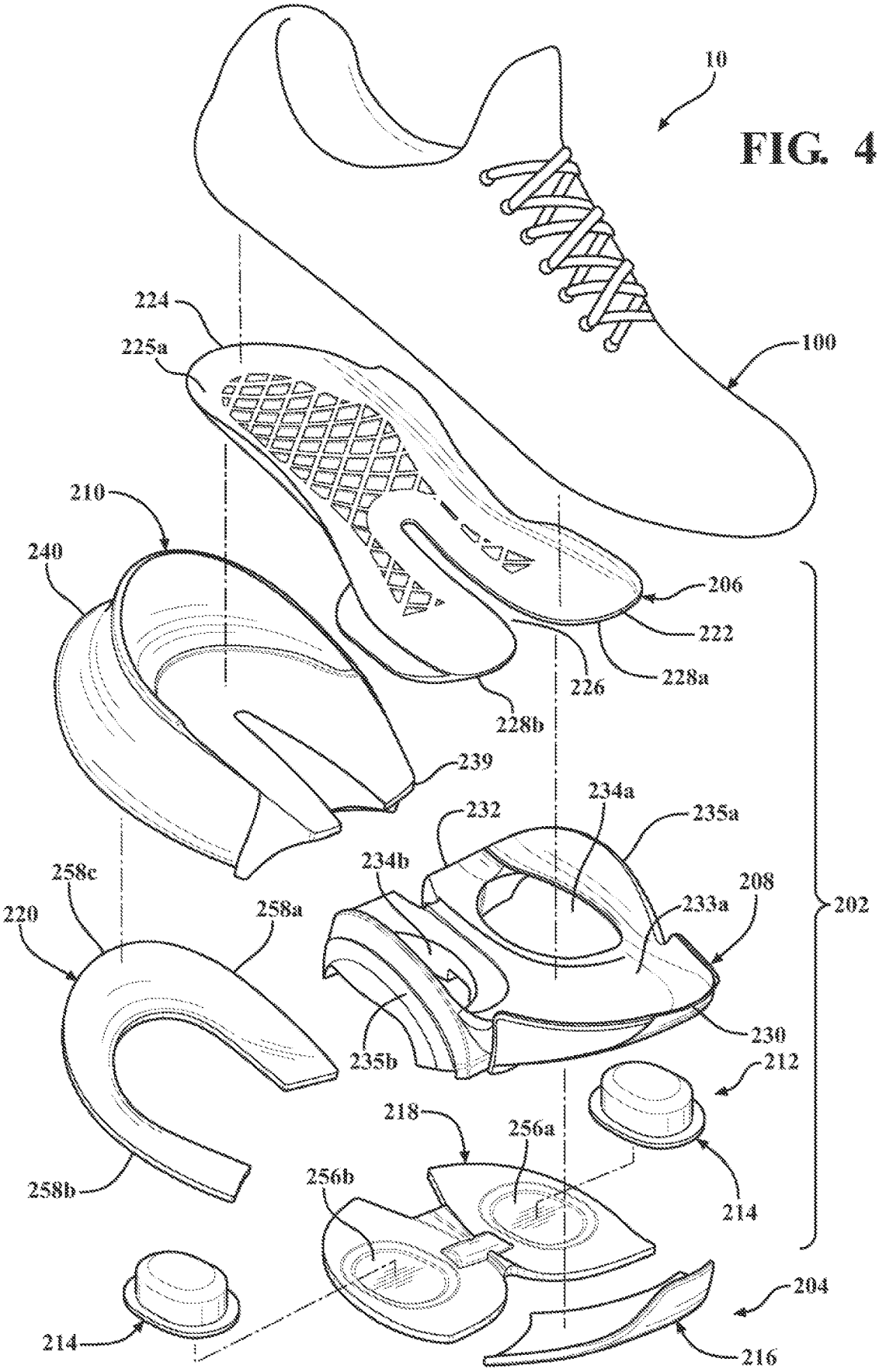
FIG. 4 is an exploded, top perspective view of the article of footwear of FIG. 1.

Referring to FIG. 4, the sole structure 200 includes a midsole 202 configured to provide characteristics of cushioning and responsiveness, and an outsole 204 configured to provide a ground-engaging surface to the article of footwear 10. Unlike conventional midsoles formed of a single slab material, the midsole 202 of the present example is formed as a composite structure and includes various subcomponents configured to impart desired characteristics to the article of footwear 10. For example, the midsole 202 includes a rigid or semi-rigid plate 206, a forefoot cushioning element 208, a heel cushioning element 210, and a fluid cushioning arrangement 212 having one or more fluid-filled bladders 214. Likewise, the outsole 204 includes a composite structure and includes a toe fragment 216 attached to the forefoot cushioning element 208 at the anterior end 12, a forefoot fragment 218 disposed in the forefoot region 20 and attached to the fluid cushioning arrangement 212, and a heel fragment 220 attached to the heel cushioning element 210 at the posterior end 14.

With continued reference to FIG. 4, the plate 206 includes an elastomeric material, such as a polyether block amide (PEBA) (e.g., Pebax® brand elastomers manufactured by Arkema S. A). The plate 206 extends from a first end 222 disposed in the forefoot region 20 to a second end 224 disposed at the posterior end 14. The plate 206 includes a top surface 225*a* attached to the strobel of the upper 100 and bottom surface 225*b* formed on an opposite side of the plate 206 from the top surface 225*a*. A distance from the top surface 225*a* to the bottom surface 225*b* defines a thickness of the plate 206. As shown, the first end 222 of the plate 206 may include a forked configuration where a gap or split 226 extends through the thickness of the plate 206 and partially along a length of the plate 206 from the first end 222. Thus, the gap 226 separates the first end 222 into medial and lateral tabs 228*a*, 228*b* that can flex independently from each other. As shown in FIG. 5, the medial and lateral tabs 228*a*, 228*b* may include sockets 229*a*, 229*b* on the bottom surface 225*b* for engaging and securing the bladders 214 of the fluid cushioning arrangement 212.

The forefoot cushioning element 208 and the heel cushioning element 210 each include a resilient polymeric material, such as foam or rubber, to impart properties of cushioning, responsiveness, and energy distribution to the foot of the wearer. The forefoot cushioning element 208 and the heel cushioning element 210 may include the same or different materials to impart desired performance characteristics to the respective regions of the sole structure 200. Example resilient polymeric materials for the cushioning elements 208, 210 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIG. 1-5, the forefoot cushioning element 208 extends from a first end 230 at the anterior end 12 to a second end 232 disposed in the mid-foot region 22. The forefoot cushioning element 208 includes a top surface 233*a* attached to the bottom surface 225*b* of the plate 206 and a bottom surface 233*b* disposed on the opposite side. A distance from the top surface 233*a* to the bottom surface 233*b* defines a thickness of the forefoot cushioning element 208. The forefoot cushioning element 208 includes one or more apertures 234*a*, 234*b* formed through the entire thickness (i.e., from the top surface 233*a* to the bottom surface 233*b*), which are configured to receive each of the bladders 214 therein. Accordingly, when the sole structure 200 is assembled, the bladders 214 of the fluid cushioning arrangement 212 will be surrounded by the forefoot cushioning element 208.

Figure 2:
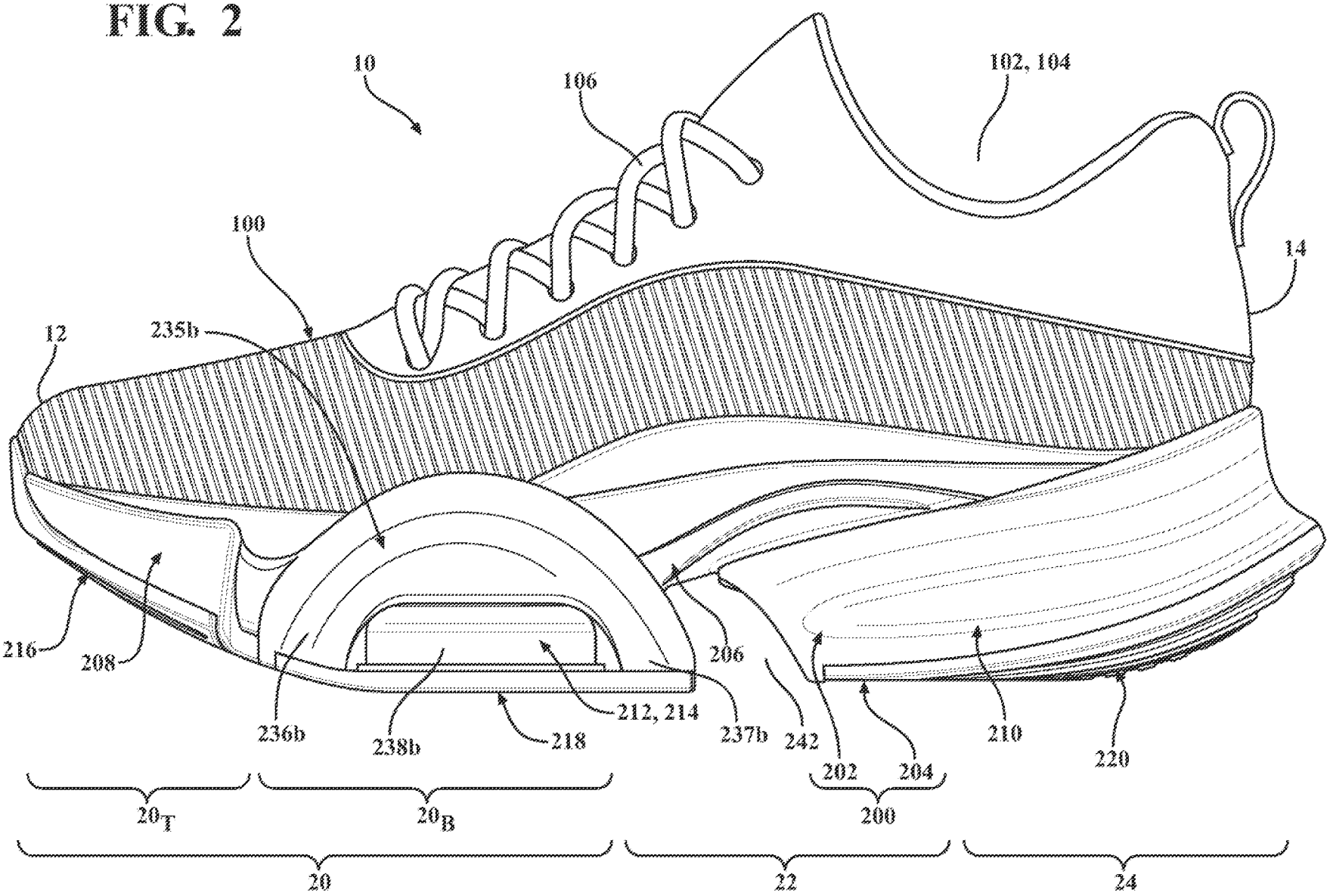
FIG. 2 is a lateral side elevation view of the article of footwear of FIG. 1.
Figure 3:
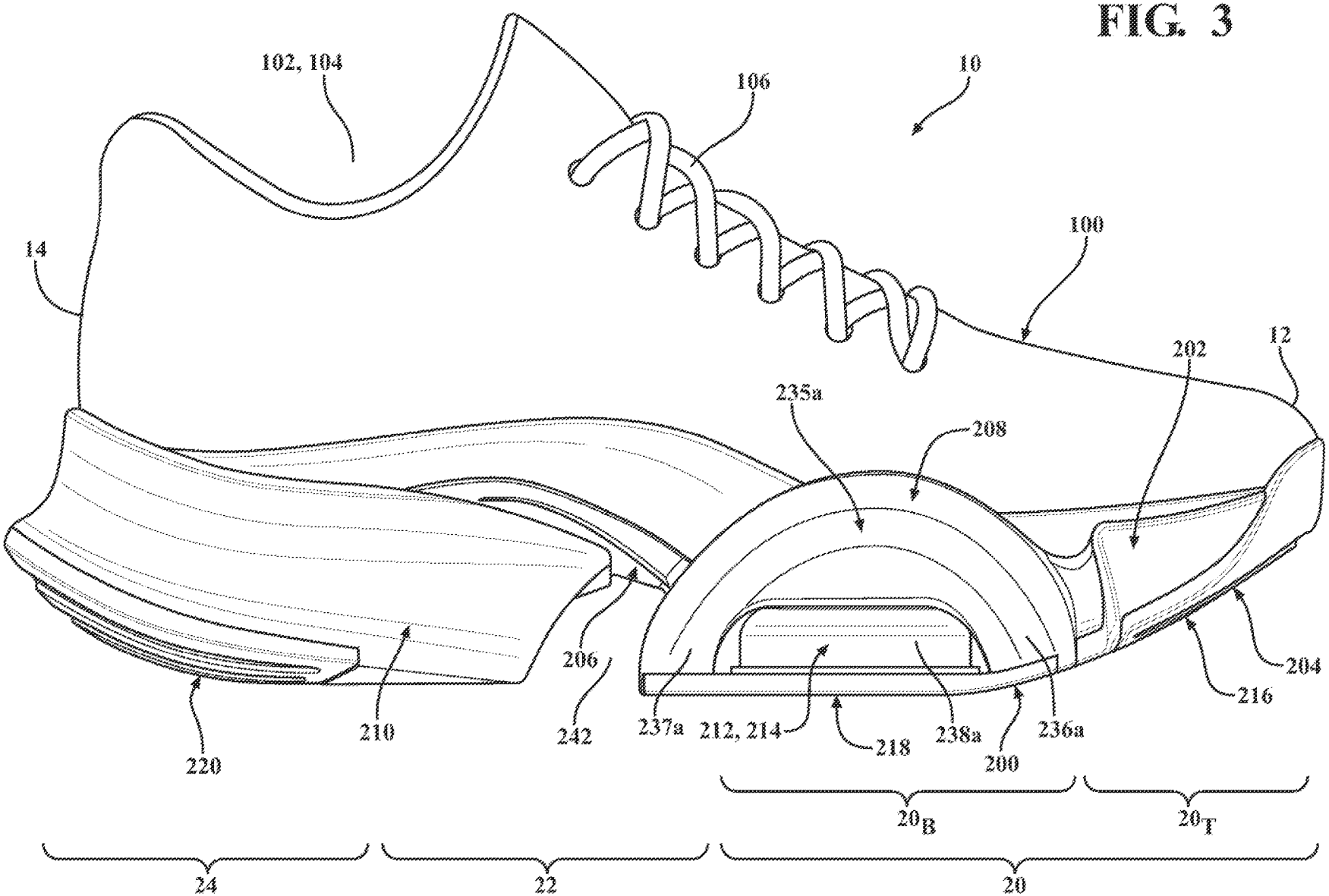
FIG. 3 is a medial side elevation view of the article of footwear of FIG. 1.

The forefoot cushioning element 208 further includes a pair of shields 235*a*, 235*b* extending upwardly from opposite sides of the forefoot cushioning element 208 between the first end 230 and the second end 232. Here, each of the shields 235*a*, 235*b* is configured to extend upwardly along one of the medial and lateral sides 16, 18 of the upper 100 in a portion of the forefoot region 20 associated with the ball of the foot, thereby providing lateral reinforcement and stability to the sides of the upper 100 in that region. In the illustrated example, each of the shields 235*a*, 235*b* is formed as an arched structure extending from a first end 236*a*, 236*b* to a second end 237*a*, 237*b* along the side of the forefoot cushioning element 208. Here, the arched structure provides the desired lateral stability, while still allowing the sole structure 200 to flex suitably across the ball portion 20B of the forefoot region 20. As best shown in FIGS. 2 and 3, the shields 235*a*-235*b* define lateral openings 238*a*, 238*b* extending from an outer periphery of the forefoot cushioning element 208 and intersecting with the apertures 234 formed through the thickness of the forefoot cushioning element 208. Thus, when the sole structure 200 is assembled, the bladders 214 may be exposed through the openings 238*a*, 238*b* formed through the forefoot cushioning element 208.

Referring still to FIGS. 1-5, the heel cushioning element 210 is attached to a bottom surface of the plate 206 and extends from a first end 239 in the mid-foot region 22 to a second end 240 at the posterior end 14 of the sole structure 200. As best shown in FIGS. 1-3, the first end 239 of the heel cushioning element 210 faces or opposes the second end 232 of the forefoot cushioning element 208. However, the first end 239 of the heel cushioning element 210 is separated from the second end 232 of the forefoot cushioning element 208 by a gap 242 in the mid-foot region 22. Here, a bottom surface of the plate 206 is exposed along the gap 242. The gap provides stability in movements commonly associated with HIIT training exercises, such as plank positions, and allows the foot to bend naturally when driving into mountain climbers. The first end 239 of the heel cushioning element 210 may include a notch 244 extending along a longitudinal direction of the article of footwear 10, such that the first end 239 is separated into medial and lateral fingers 246*a*, 246*b* that can move independently of each other.

The fluid cushioning arrangement 212 of the illustrated example includes a pair of bladders 214 each defining a respective chamber for including a pressurized fluid. A first one of the bladders 214 is disposed on the medial side 16 of the sole structure 200 in the forefoot region 20, and a second one of the bladders 214 is disposed on the lateral side 18 of the sole structure 200 in the forefoot region 20. As discussed above, each of the bladders 214 extends through one of the apertures 234 formed through the forefoot cushioning element 208 such that a top surface of each bladder 214 is received within one of the sockets 229*a*, 229*b* and attached to the bottom surface 225*b* of the plate 206, and a bottom surface of each bladder 214 is received by a socket the forefoot fragment 218 of the outsole 204.

Figure 8:
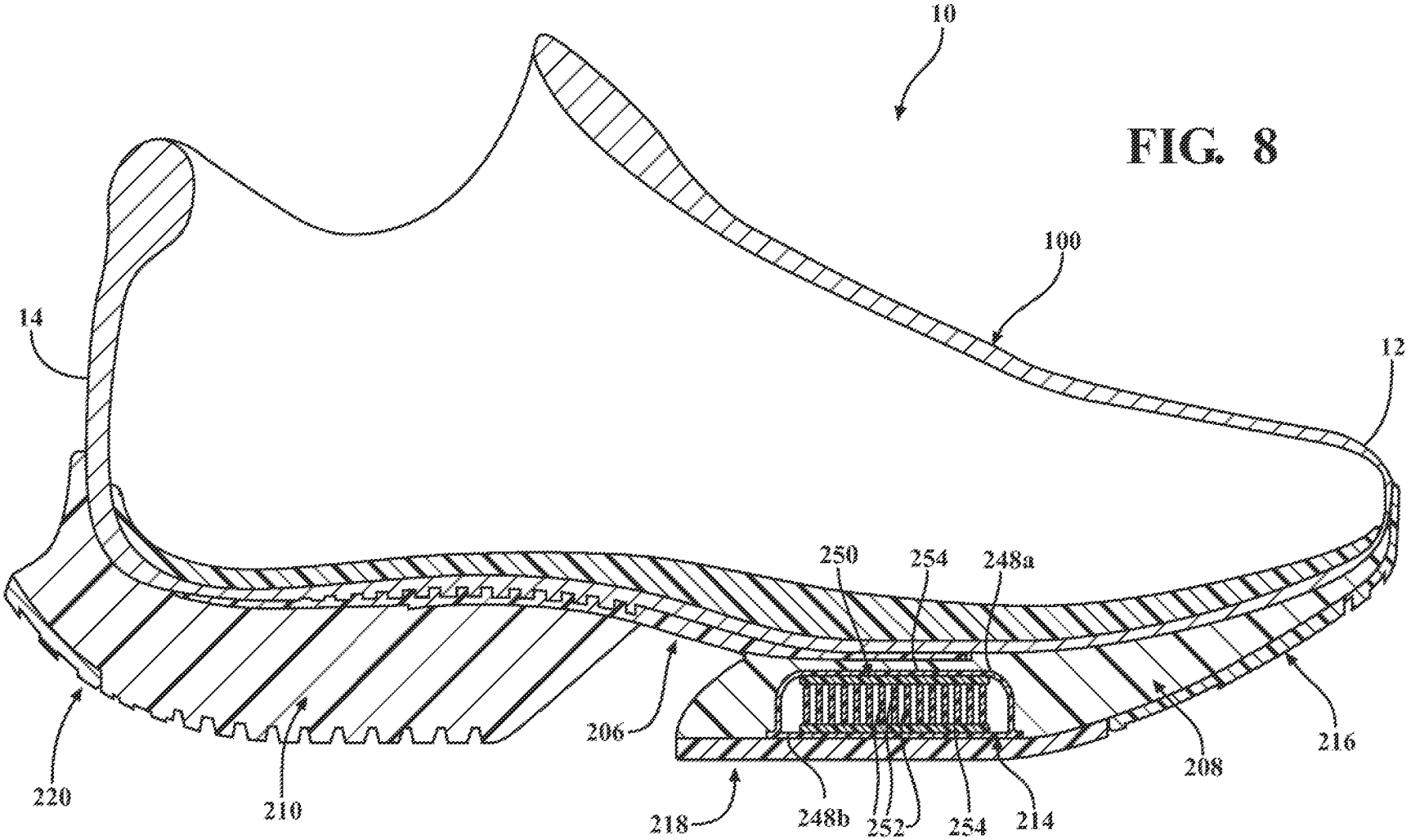
FIG. 8 is a cross-sectional view of the article of footwear of FIG. 1; taken along section line 8-8 of FIG. 6.
Figure 9:
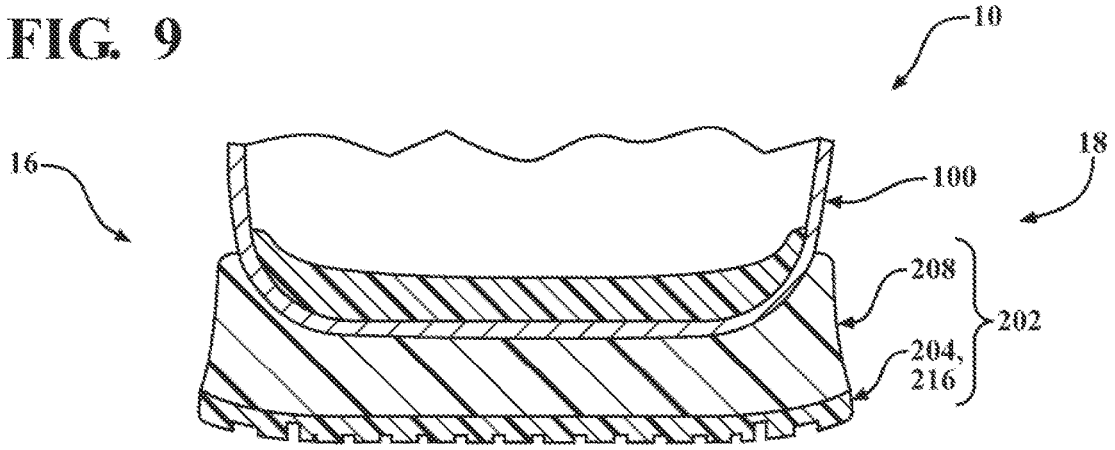
FIG. 9 is a cross-sectional view of the article of footwear of FIG. 1; taken along section line 9-9 of FIG. 6.
Figure 10:
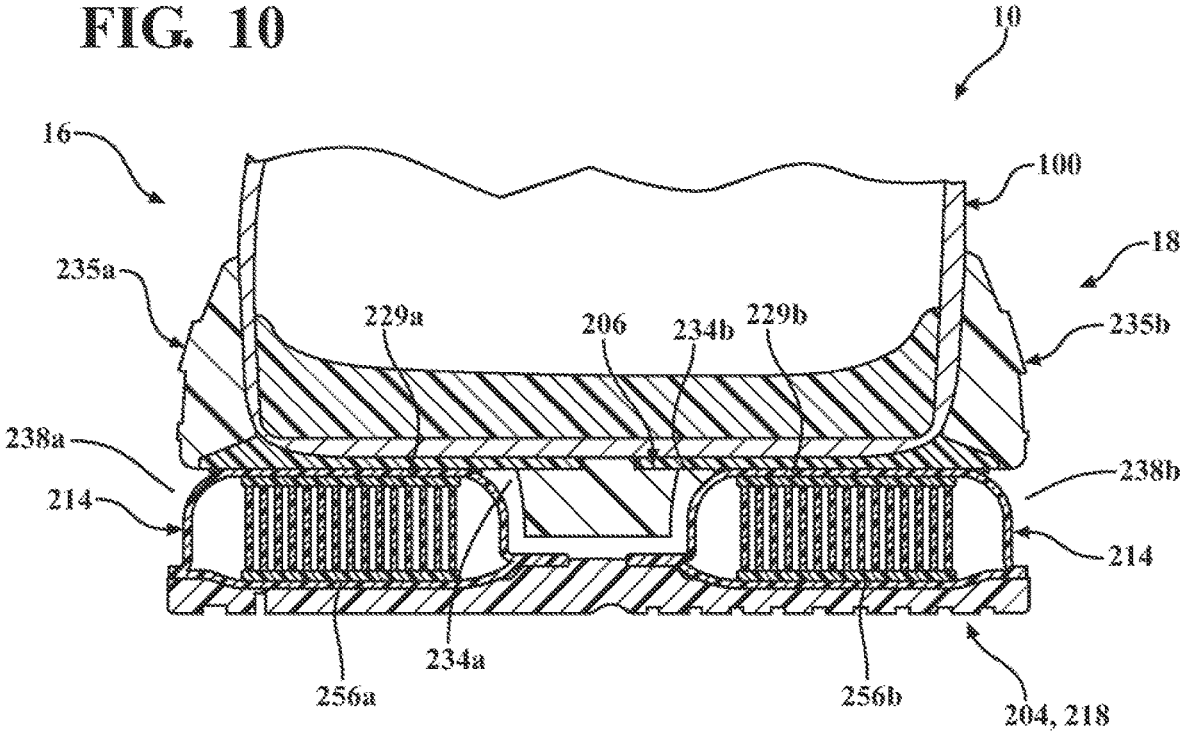
FIG. 10 is a cross-sectional view of the article of footwear of FIG. 1; taken along section line 10-10 of FIG. 6.
Figure 11:
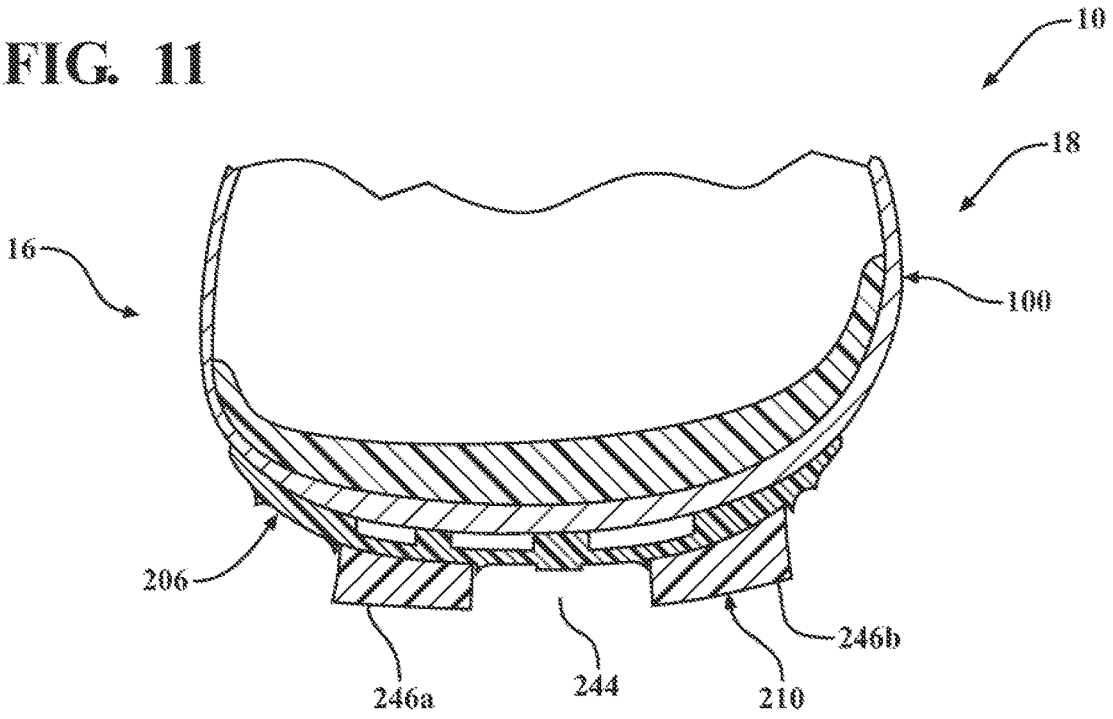
FIG. 11 is a cross-sectional view of the article of footwear of FIG. 1; taken along line 11-11 of FIG. 6.
Figure 12:
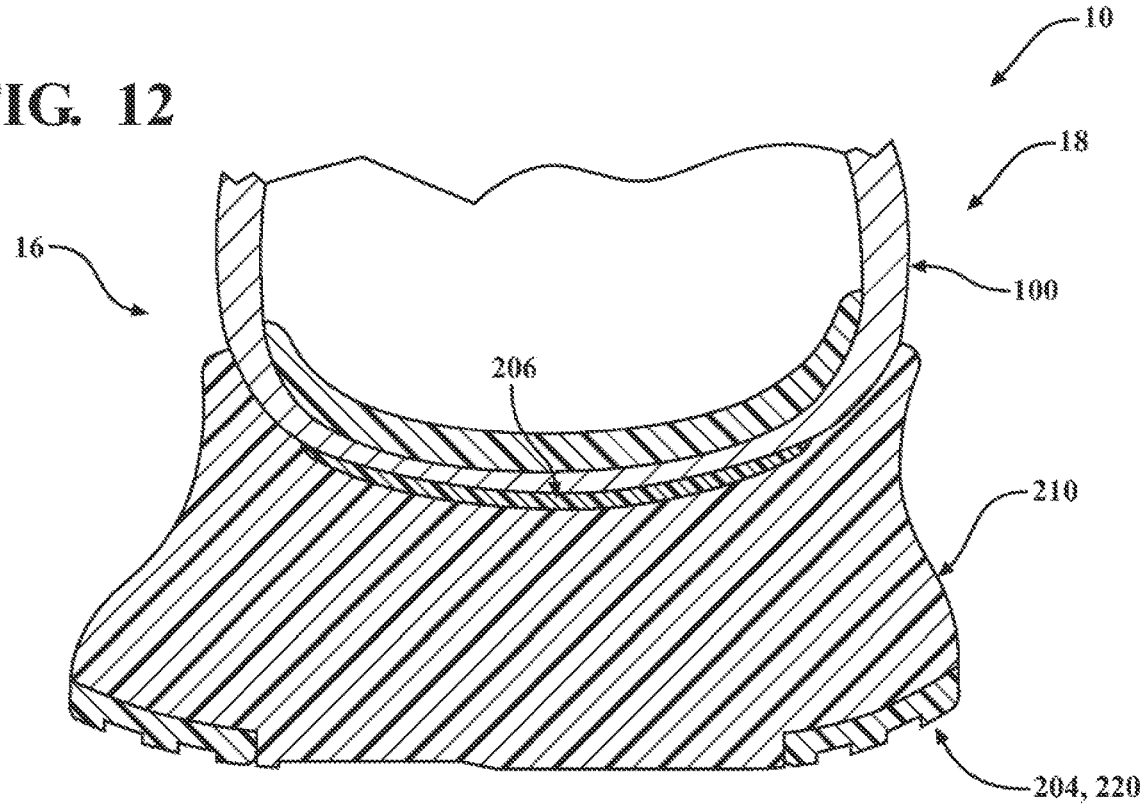
FIG. 12 is a cross-sectional view of the article of footwear of FIG. 1, taken along line 12-12 of FIG. 6.

Each of the bladders 214 may include a first barrier element 248*a* and a second barrier element 248*b* formed of an elastomeric material. The chamber of each of the bladders 214 may receive a tensile element 250 (FIG. 8) therein. Each tensile element 250 may include a series of tensile strands 252 extending between an upper tensile sheet 254 and a lower tensile sheet 254. The upper tensile sheet 254 may be attached to the first barrier element 248*a* while the lower tensile sheet 254 may be attached to the second barrier element 248*b*. In this manner, when the bladder 214 receives the pressurized fluid, the tensile strands 252 of the tensile element 250 are placed in tension. Because the upper tensile sheet 254 is attached to the first barrier element 248*a* and the lower tensile sheet 254 is attached to the second barrier element 248*b*, the tensile strands 252 retain a desired shape of the bladder 214 when the pressurized fluid is injected into the chamber.

With continued reference to FIG. 4, the toe fragment 216 of the outsole 204 is formed of a resilient elastomeric material, and is disposed at the anterior end 12 of the sole structure 200. The forefoot fragment 218 is disposed in the forefoot region 20 and is formed independently of each of the toe fragment 216 and the heel fragment 220. As shown, the forefoot fragment 218 includes one or more sockets 256*a*, 256*b* formed in a top surface, which are configured to receive and secure a lower portion of corresponding ones of the bladders 214. Thus the forefoot fragment 218 provides a bottom structure for securing the bladders 214. In some instances, the forefoot fragment 218 may be formed of a material having a greater rigidity than the other fragments 216, 220 to impart stability between the independent bladders 214.

The heel fragment 220 extends around the heel region 24 and includes a first segment 258*a* extending along the medial side 16, a second segment 258*b* extending along the lateral side 18, and an arcuate third segment 258*c* extending around the posterior end 14. As shown, the second segment 258*b* may be longer than the first segment 258*a*.

Figure 13:
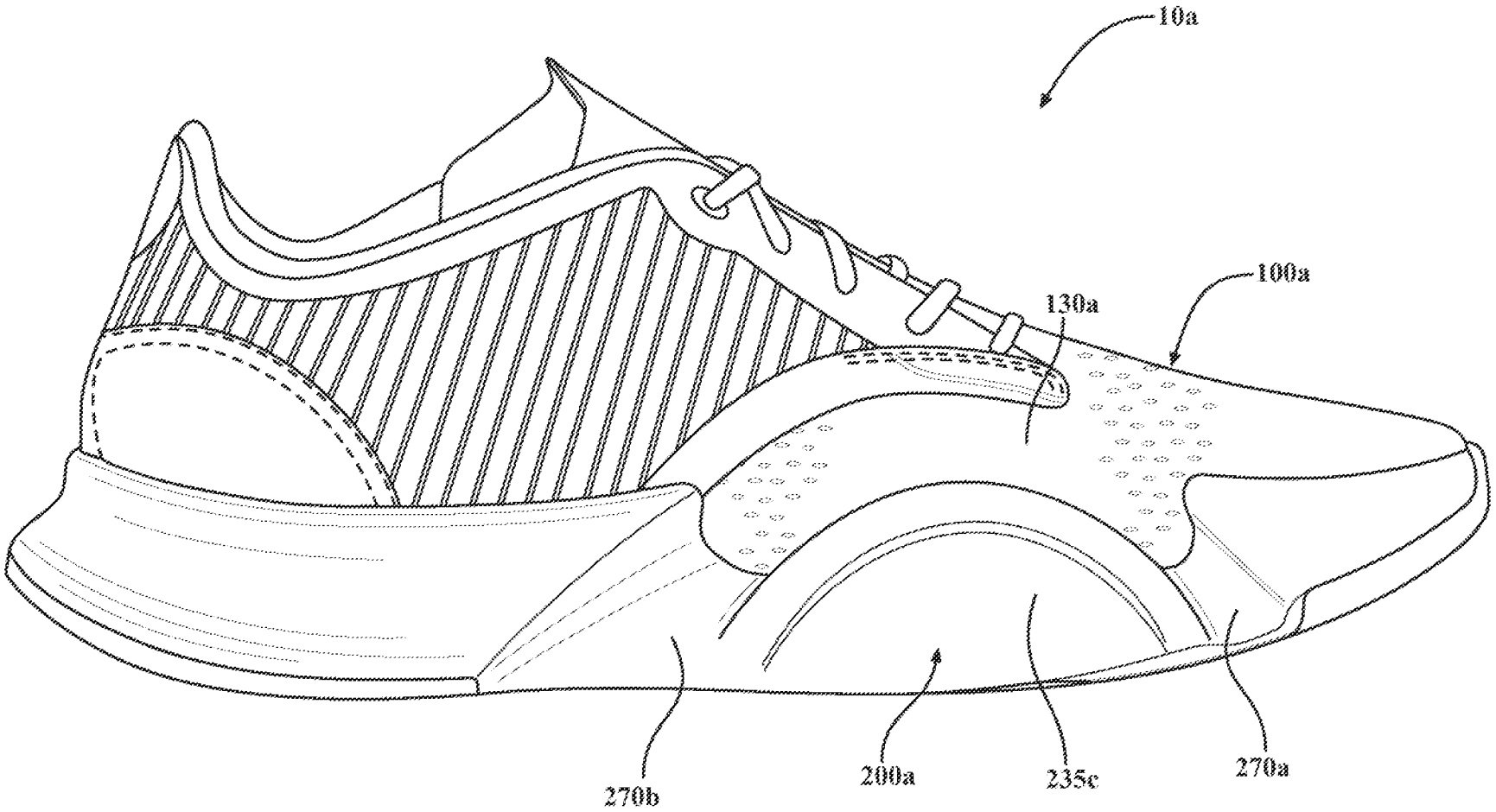
FIG. 13 is a lateral side elevation view of another example of an article of footwear according to the principles of the present disclosure.
Figure 14:
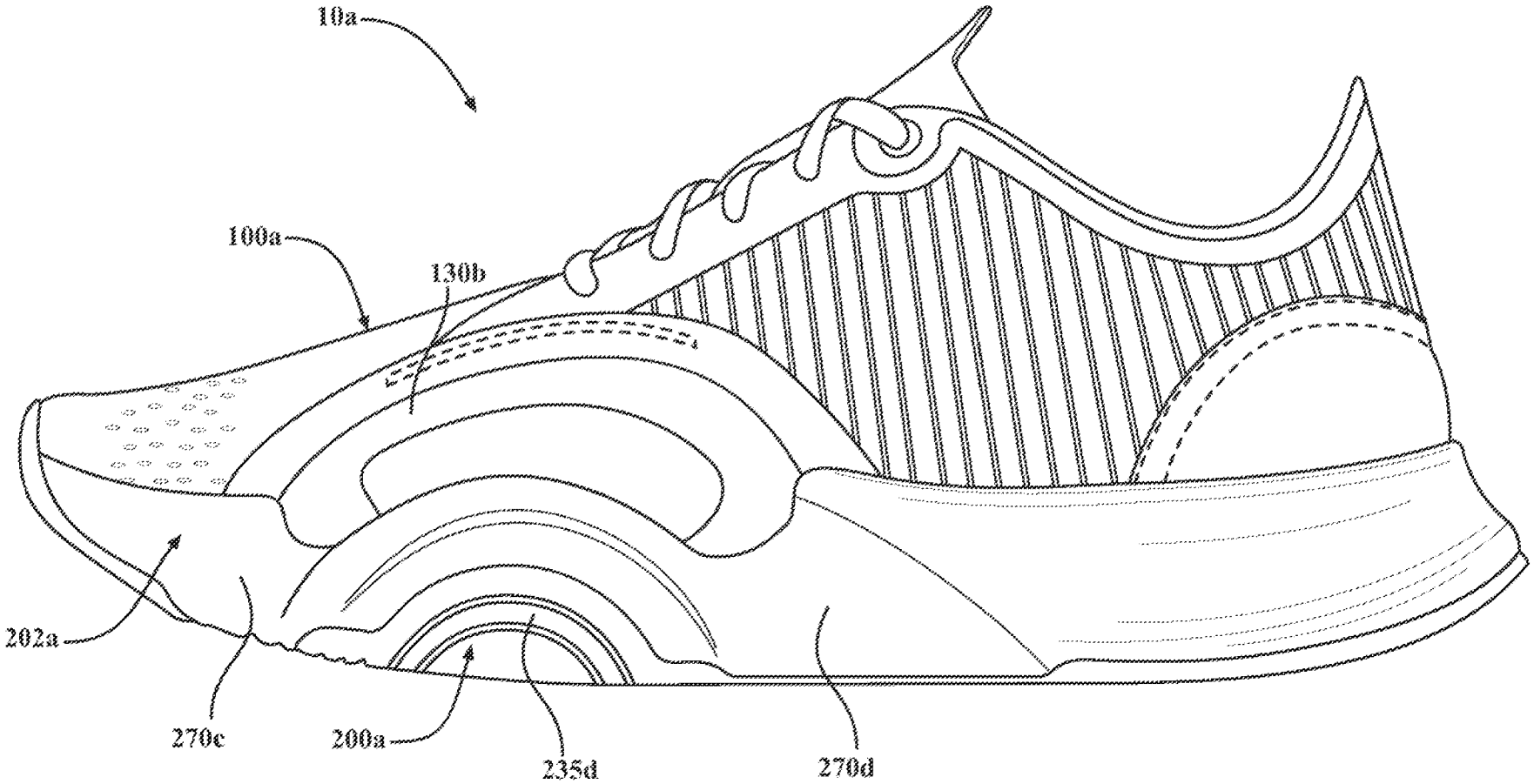
FIG. 14 is a medial side elevation view of the article of footwear of FIG. 13.
Figure 15:
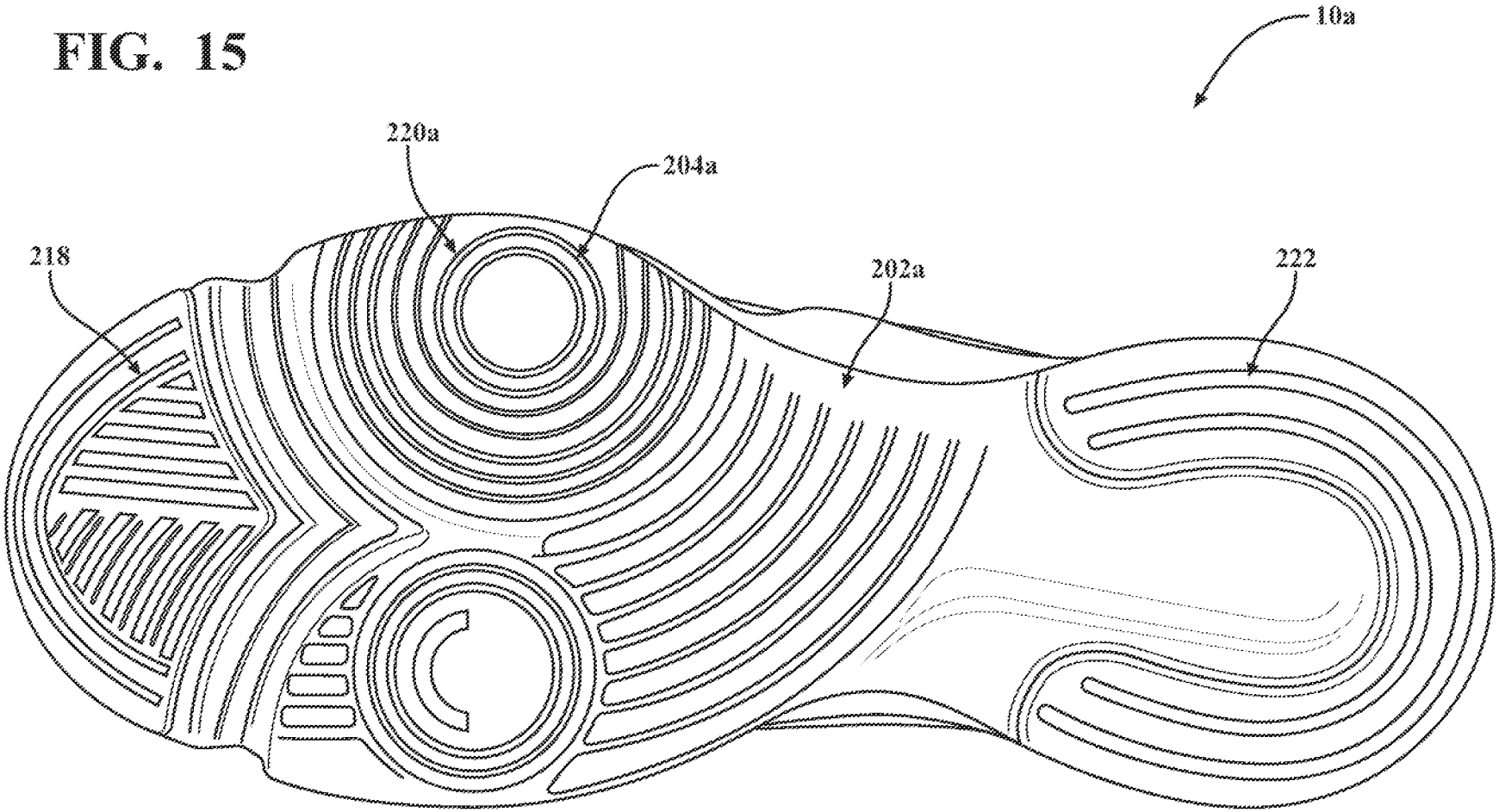
FIG. 15 is a bottom plan view of the article of footwear of FIG. 13.
Figure 16:
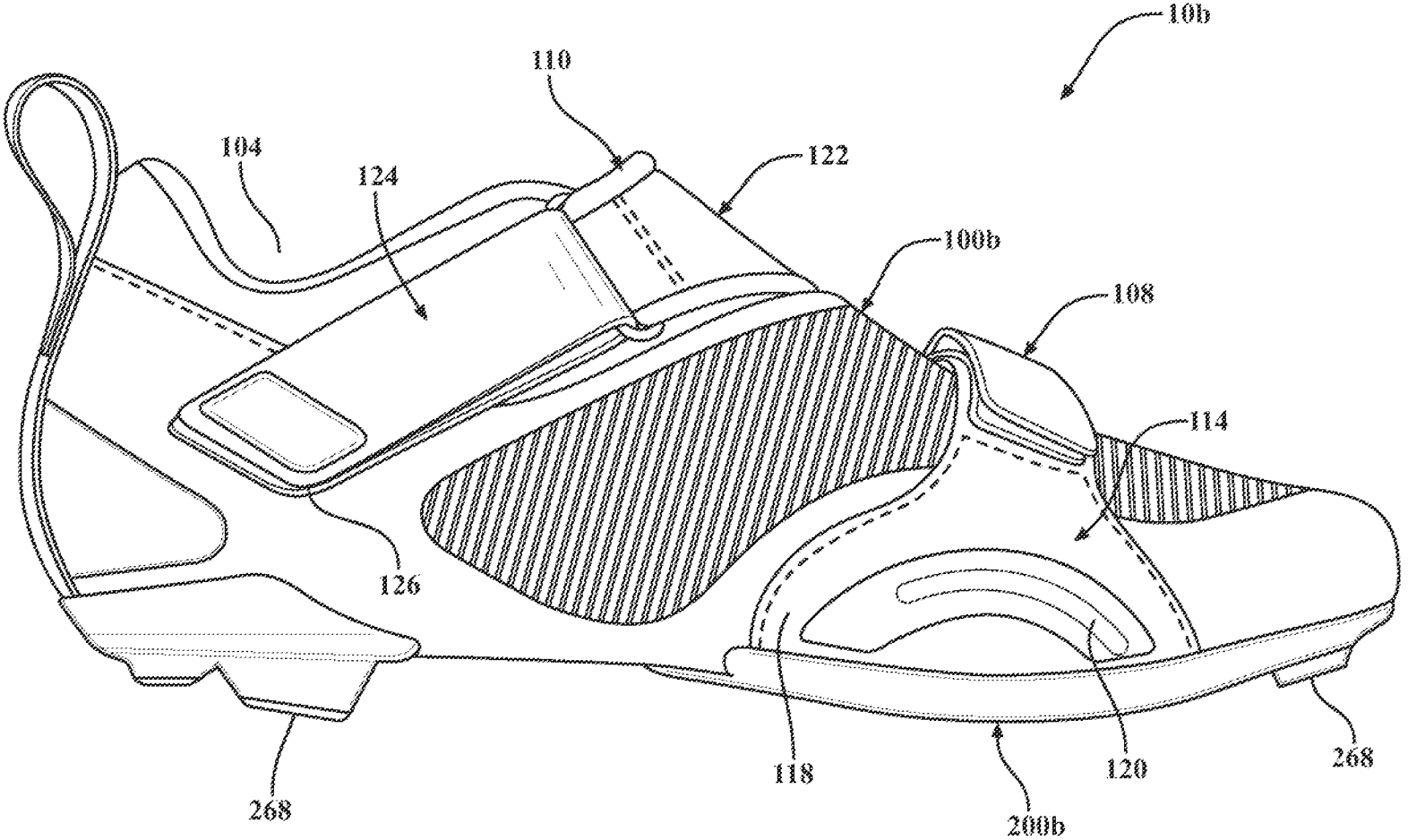
FIG. 16 is a lateral side elevation view of another example of an article of footwear according to the principles of the present disclosure.

With particular reference to FIGS. 13-15, an article of footwear 10*a* is provided and includes an upper 100*a* a sole structure 200*a* attached to the upper 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the article of footwear of FIGS. 13-15, the sole structure 200*a* includes a unitary midsole 202*a* including a single cushioning element including a foam material extending from the anterior end 12 to the posterior end 14. Here, sole structure 200*a* does not include independent cushioning elements or bladders. The midsole 202*a* includes medial and lateral side shields 235*c*, 235*d* having a narrower profile than the side shields 235*a*, 235*b* of the previous example. In this example, the side shields 235*c*, 235*d* are formed as solid (i.e., not including openings) elements along the sides of the midsole 202*a*. Optionally, the midsole 202*a* may include arcuate relief channels 270*a*-270*d* formed in the peripheral surface of the midsole 202*a* on opposite ends of the side shields 235*c*, 235*d* to allow the midsole 202*a* to bend about the side shields 235*c*, 235*d*. Thus, the sole structure 200*a* is configured as a simplified, lightweight alternative to the sole structure 200. The minimalistic sole structure 200*a* may be desirable for travel (i.e., packing in luggage) and for use in confined areas.

The upper 100*a* of the article of footwear 10*a* may include arcuate flex zones 130*a*, 130*b* partially surrounding the side shields 235*c*, 235*d*. As shown, the flex zones 130*a*, 130*b* each extend from a first one of the relief channels 130*a*, 130*c* at an anterior end of one of the side shields 235*c*, 235*d* to a second one of the relief channels 130*b*, 130*d* formed at an anterior end of the respective side shield 235*c*, 235*d*. Thus, the upper 100*a* cooperates with the relief channels 170*a*-170*d* to provide flexibility along the metatarsophalangeal (MTP) joint.

With particular reference to FIGS. 16-19, an article of footwear 10*b* is provided and includes an upper 100*b* and a sole structure 200*b* attached to the upper 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

Referring to FIGS. 16-19, another example of an article of footwear 10*b* according to the principles of the present disclosure is configured for use with a bicycle. The upper 100*b* includes a translucent mesh material extending over the forefoot region 20 and along the lateral side 18 along the mid-foot region 22. The upper 100*b* further includes a forefoot strap 108 and a mid-foot strap 110 each extending over the upper 100*b* from the medial side 16 to the lateral side 18.

The forefoot strap 108 includes a medial forefoot band 112 attached at a biteline formed between the upper 100*b* and the sole structure 200*b* on the medial side 16 and a lateral forefoot band 114 attached at the biteline on the lateral side 18. Each of the forefoot bands 112, 114 includes a fixed end 116, 118 attached at the biteline and a free end operable to adjustably attach to the free end of the other forefoot band 112, 114. As shown, the fixed ends 116, 118 of the forefoot bands 112, 114 are flared (i.e., increase in width along a direction towards the biteline) and include an arcuate reinforcement strip 120 attached to or embedded within the fixed end 116, 118. Thus, the fixed ends 116, 118 of the forefoot strap 108 may function similar to the shields 235*a*, 235*b* discussed above to provide lateral stability along the ball region of the foot while also allowing the upper to flex or bend along the metatarsophalangeal (MTP) joint.

Figure 17:
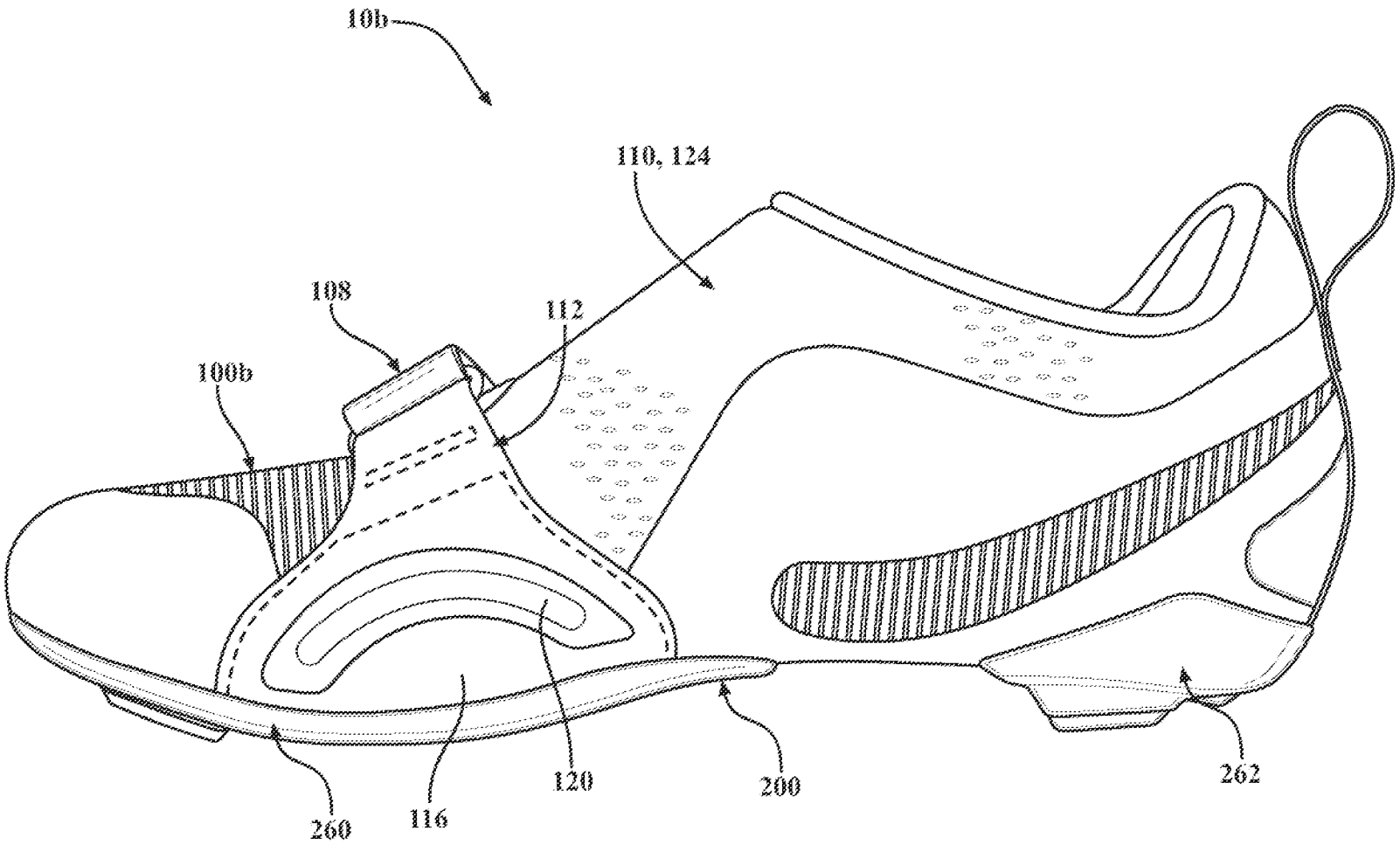
FIG. 17 is a medial side elevation view of the article of footwear of FIG. 16.
Figure 18:
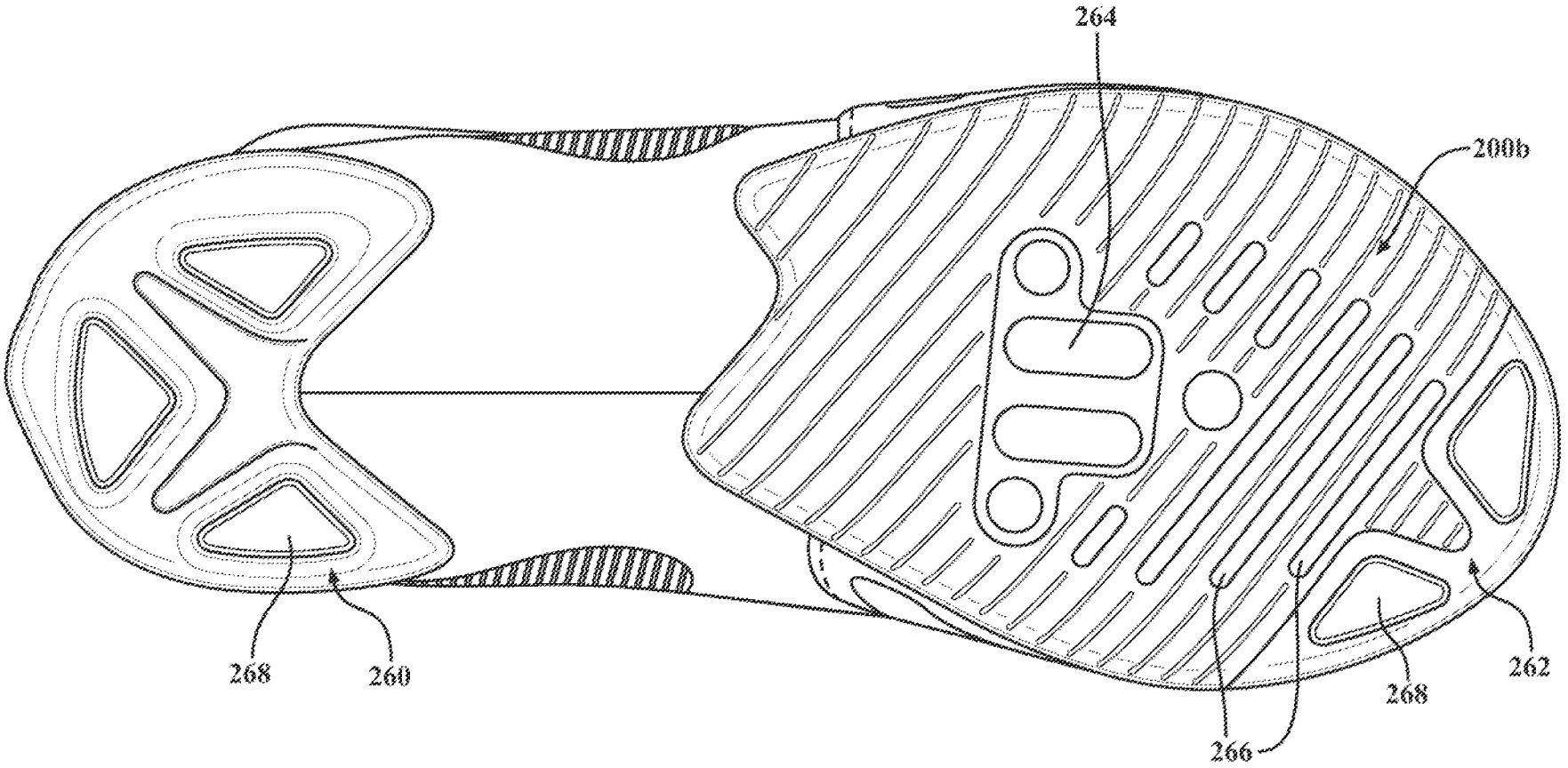
FIG. 18 is a bottom plan view of the article of footwear of FIG. 16.
Figure 19:
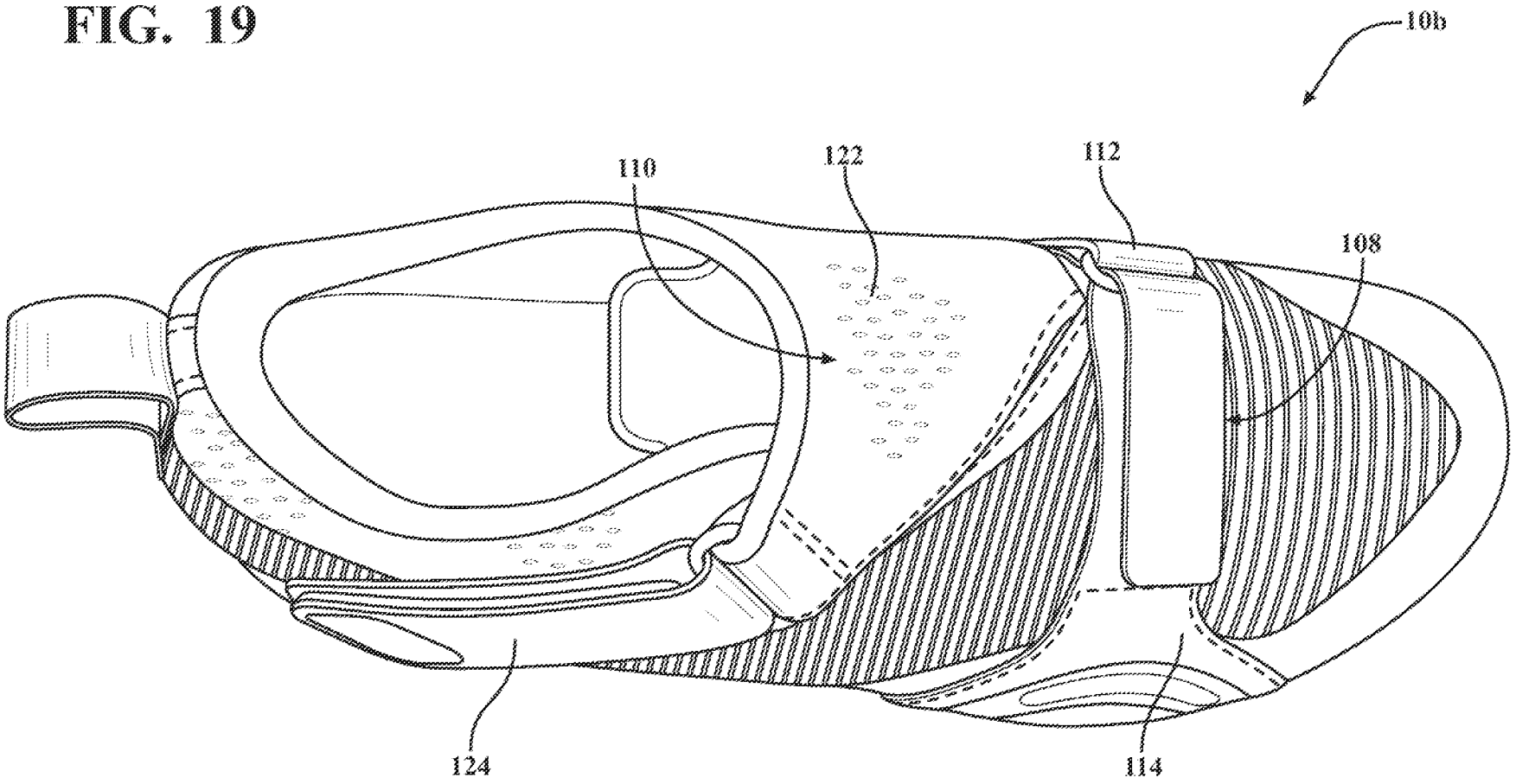
FIG. 19 is a top plan view of the article of footwear of FIG. 16.

The mid-foot strap 110 includes a medial mid-foot band 122 and a lateral mid-foot band 124 cooperating to extend over the upper 100*b* adjacent to the ankle opening 104. The medial mid-foot band 122 is integrally formed with the upper 100*b*, as shown in FIGS. 17 and 19. Thus, medial mid-foot band 122 extends along the medial side of the footwear and defines a medial quarter panel and a medial heel panel. When the medial mid-foot band 122 is attached to the lateral mid-foot band 124, the medial mid-foot band 122 can be drawn over an instep region of the foot to adjust a size of the upper 100*b* and the ankle opening 104. Here, the lateral mid-foot band 124 includes a fixed end 126 attached to the upper 100*b* on a lateral side 18 of the ankle opening 104 and a second end configured to adjustably attach to the medial mid-foot band 122.

The sole structure 200*b* includes a forefoot plate 260 and a heel plate 262 attached to the upper 100*b*. The forefoot plate 260 includes a coupler 264 with SPD and Delta cleats. The forefoot plate 260 also includes a plurality of vents 266 formed through a thickness of the forefoot plate 260 and in communication with the interior void 102 of the upper 100 to provide ventilation to the plantar surface of the foot within the upper 100*b*. Each of the forefoot plate 260 and the heel plate 262 includes resilient studs 268 to provide traction during walking.

Using fluid-filled bladders with tensile members in the forefoot not only creates a dynamic aesthetic, but also helps provide impact protection and responsiveness. The fluid-filled cushioning arrangement a two-unit system under the forefoot does not act alone. A plate running from the heel to the forefoot helps roll the foot forward and into a ready position for the majority of upright I-HIT movements. The upper is crafted to support lateral moves, such as skaters and side lunges.

The following Clauses provide an exemplary configuration for a sole structure and an article of footwear described above.

Clause 1: An article of footwear comprising: an upper; a plate having a top surface facing the upper and a bottom surface formed on an opposite side than the top surface, the plate extending from a first end in a forefoot region to a second end in a heel region; a first cushioning element having an upper surface attached to the bottom surface of the plate in the forefoot region and including a first side shield extending from the upper surface and along a medial side of the upper and a second side shield extending from the upper surface and along a lateral side of the upper; and one or more fluid-filled bladders each at least partially surrounded by the first cushioning element in the forefoot region and having a top surface attached to the bottom surface of the plate.

Clause 2: The article of footwear of Clause 1, wherein the one or more fluid-filled bladders includes a first fluid-filled bladder disposed on a medial side and a second fluid-filled bladder disposed on a lateral side.

Clause 3: The article of footwear of any of the preceding Clauses, wherein the first end of the plate includes a lateral portion and a medial portion separated from the lateral portion by a gap.

Clause 4: The article of footwear of any of the preceding Clauses, wherein the first cushioning element includes one or more apertures each configured to receive a corresponding one of the one or more fluid-filled bladders.

Clause 5: The article of footwear of any of the preceding Clauses, wherein each of the plate and the upper are received between the first side shield and the second side shield.

Clause 6: The article of footwear of any of the preceding Clauses, wherein the one or more fluid-filled bladders is disposed between the first side shield and the second side shield.

Clause 7: The article of footwear of any of the preceding Clauses, wherein each of the first side shield and the second side shield includes an arch extending from a first end to a second end along the respective side of the article of footwear.

Clause 8: The article of footwear of any of the preceding Clauses, wherein further comprising a second cushioning element disposed in the heel region and spaced apart from the first cushioning element by a gap in a mid-foot region of the article of footwear.

Clause 9: The article of footwear of Clause 8, further comprising an outsole having a first fragment attached to the first cushioning element, a second fragment attached to the second cushioning element, and a third fragment attached to the one or more fluid-filled bladders.

Clause 10: The article of footwear of Clause 9, wherein the plate includes one or more upper sockets each receiving a first end of one of the one or more bladders and the outsole includes one or more lower sockets each receiving a second end of one of the one or more bladders.

Clause 11: An article of footwear comprising: an upper; a plate having a top surface facing the upper and a bottom surface formed on an opposite side than the top surface, the plate extending from a first end in a forefoot region to a second end in a heel region; a first cushioning element having an upper surface attached to the bottom surface of the plate in the forefoot region and including a first side shield defining a first opening formed in a lateral side of the first cushioning element and a second side shield defining a second opening formed in a medial side of the first cushioning element; and one or more fluid-filled bladders each at least partially surrounded by the first cushioning element in the forefoot region and having a top surface attached to the bottom surface of the plate.

Clause 12: The article of footwear of Clause 11, wherein the one or more fluid-filled bladders includes a first fluid-filled bladder disposed on a medial side and a second fluid-filled bladder disposed on a lateral side.

Clause 13: The article of footwear of any of the preceding Clauses, wherein the first end of the plate includes a lateral portion and a medial portion separated from the lateral portion by a gap.

Clause 14: The article of footwear of any of the preceding Clauses, wherein the first cushioning element includes one or more apertures each configured to receive a corresponding one of the one or more fluid-filled bladders.

Clause 15: The article of footwear of any of the preceding Clauses, wherein each of the plate and the upper are received between the first side shield and the second side shield.

Clause 16: The article of footwear of any of the preceding Clauses, wherein the one or more fluid-filled bladders is disposed between the first side shield and the second side shield.

Clause 17: The article of footwear of any of the preceding Clauses, wherein each of the first side shield and the second side shield includes an arch extending from a first end to a second end along the respective side of the article of footwear.

Clause 18: The article of footwear of any of the preceding Clauses, wherein further comprising a second cushioning element disposed in the heel region and spaced apart from the first cushioning element by a gap in a mid-foot region of the article of footwear.

Clause 19: The article of footwear of Clause 18, further comprising an outsole having a first fragment attached to the first cushioning element, a second fragment attached to the second cushioning element, and a third fragment attached to the one or more fluid-filled bladders.

Clause 20: The article of footwear of Clause 19, wherein the plate includes one or more upper sockets each receiving a first end of one of the one or more bladders and the outsole includes one or more lower sockets each receiving a second end of one of the one or more bladders.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

a plate having a top surface facing the upper and a bottom surface formed on an opposite side than the top surface, the plate extending from a first end in a forefoot region to a second end in a heel region and including a gap defining a first projection and a second projection operable to flex relative to one another;

a first fluid-filled bladder attached to the bottom surface of the plate and disposed entirely on the first projection;

a second fluid-filled bladder attached to the bottom surface of the plate and disposed entirely on the second projection; and a first cushion having a top surface attached to the bottom surface of the plate in the forefoot region, the first cushion including a first aperture extending from the top surface of the first cushion to a bottom surface of the first cushion and entirely encircled by the first cushion, and a second aperture extending from the top surface of the first cushion to the bottom surface of the first cushion and entirely encircled by the first cushion, the first aperture receiving the first fluid-filled bladder and the second aperture receiving the second fluid-filled bladder.

2. The article of footwear of claim 1, wherein the first fluid-filled bladder is disposed on a medial side of the plate and the second fluid-filled bladder is disposed on a lateral side of the plate.

3. The article of footwear of claim 1, wherein the first projection includes a first socket operable to receive the first fluid-filled bladder and the second projection includes a second socket operable to receive the second fluid-filled bladder.

4. The article of footwear of claim 3, wherein the first socket and the second socket are formed in the bottom surface of the plate proximate to a respective distal end of the first projection and the second projection.

5. The article of footwear of claim 1, wherein the first fluid-filled bladder and the second fluid-filled bladder extend through the first cushion, the first fluid-filled bladder and the second fluid-filled bladder each including a first surface attached to the bottom surface of the plate and a second surface formed on an opposite side of the respective first fluid-filled bladder and the second fluid-filled bladder than the first surface and attached to an outsole.

6. The article of footwear of claim 1, further comprising a second cushion disposed in the heel region and spaced apart from the first cushion by a gap in a mid-foot region of the article of footwear.

7. The article of footwear of claim 6, further comprising an outsole having a first portion attached to the first cushion, a second portion attached to the second cushion, and a third portion attached to the first fluid-filled bladder and the second fluid-filled bladder.

8. The article of footwear of claim 6, wherein the plate is exposed in the gap defined between the first cushion and the second cushion.

9. An article of footwear comprising:

an upper;

a plate having a top surface facing the upper and a bottom surface formed on an opposite side than the top surface, the plate extending from a first end in a forefoot region to a second end in a heel region and including a gap defining a first projection and a second projection;

a first cushion having a top surface attached to the bottom surface of the plate in the forefoot region and including a first side shield extending from the top surface of the first cushion and along an outer surface of the upper at a medial side of the upper and a second side shield extending from the top surface of the first cushion and along the outer surface of the upper at a lateral side of the upper;

a first aperture formed through a thickness of and entirely encircled by the first cushion;

a second aperture formed through the thickness of and entirely encircled by the first cushion;

a first fluid-filled bladder attached to the bottom surface of the plate, disposed entirely on the first projection, and surrounded by the first cushion, the first aperture receiving the first fluid-filled bladder; and a second fluid-filled bladder attached to the bottom surface of the plate, disposed entirely on the second projection, and surrounded by the first cushion, the second aperture receiving the second fluid-filled bladder.

10. The article of footwear of claim 9, wherein the first fluid-filled bladder is disposed on a medial side of the plate and the second fluid-filled bladder is disposed on a lateral side of the plate.

11. The article of footwear of claim 9, wherein the first projection and the second projection are operable to flex relative to one another.

12. The article of footwear of claim 11, wherein the first projection includes a first socket operable to receive the first fluid-filled bladder and the second projection includes a second socket operable to receive the second fluid-filled bladder.

13. The article of footwear of claim 12, wherein the first socket and the second socket are formed in the bottom surface of the plate proximate to a respective distal end of the first projection and the second projection.

14. The article of footwear of claim 9, wherein the first fluid-filled bladder and the second fluid-filled bladder extend through the first cushion, the first fluid-filled bladder and the second fluid-filled bladder each including a first surface attached to the bottom surface of the plate and a second surface formed on an opposite side of the respective first fluid-filled bladder and the second fluid-filled bladder than the first surface and attached to an outsole.

15. The article of footwear of claim 9, further comprising a second cushion disposed in the heel region and spaced apart from the first cushion by a gap in a mid-foot region of the article of footwear.

16. The article of footwear of claim 15, further comprising an outsole having a first portion attached to the first cushion, a second portion attached to the second cushion, and a third portion attached to the first fluid-filled bladder and the second fluid-filled bladder.

17. The article of footwear of claim 15, wherein the plate is exposed in the gap defined between the first cushion and the second cushion.

* * * * *